US010179634B2

(12) United States Patent
Van Rompay

(10) Patent No.: US 10,179,634 B2
(45) Date of Patent: Jan. 15, 2019

(54) DEVICE AND METHOD FOR CLEANING A SUBMERGED SURFACE OF A VESSEL OR SIMILAR AND USE OF SUCH A DEVICE

(71) Applicant: Boudewijn Gabriel Van Rompay, Clearwater, FL (US)

(72) Inventor: Boudewijn Gabriel Van Rompay, Clearwater, FL (US)

( * ) Notice: Subject to any disclaimer, the term of this patent is extended or adjusted under 35 U.S.C. 154(b) by 359 days.

(21) Appl. No.: 14/950,682

(22) Filed: Nov. 24, 2015

(65) Prior Publication Data

US 2016/0144937 A1 May 26, 2016

(30) Foreign Application Priority Data

Nov. 25, 2014 (BE) ..... 2014/5086

(51) Int. Cl.
*B63B 59/02* (2006.01)
*B08B 1/00* (2006.01)
(Continued)

(52) U.S. Cl.
CPC ..... *B63B 59/08* (2013.01); *A46B 13/02* (2013.01); *B08B 1/002* (2013.01); *B08B 1/008* (2013.01);
(Continued)

(58) Field of Classification Search
CPC ... B63B 59/06; B63B 2059/065; B63B 59/08; B63B 2059/082; B63B 2059/085;
(Continued)

(56) References Cited

U.S. PATENT DOCUMENTS 5,174,222 A * 12/1992 Rogers ..... B63B 59/08 114/222
5,947,051 A * 9/1999 Geiger ..... B62D 57/00 114/222

(Continued)

FOREIGN PATENT DOCUMENTS

FR 2 560 850 A1 9/1985
JP S61 36092 A 2/1986

OTHER PUBLICATIONS

BE Search Report, dated Aug. 6, 2015, 2013, from corresponding BE application.

*Primary Examiner* — Ajay Vasudeva
(74) *Attorney, Agent, or Firm* — Young & Thompson

(57) ABSTRACT

Device (3) for cleaning a submerged surface (12) of a vessel (7) includes a cleaning module (2) with at least one rotating brush (11) which, upon the movement of the cleaning module, ensures that the cleaning module is pushed or sucked against the aforementioned surface (12), wherein the device (3) is further provided with a launch platform (1) that can place the cleaning module against the surface and which is connected thereto by a first cable (15) for the control of the cleaning module, this launch platform being provided with at least one camera (4) and a drive (8) to move the launch platform underwater, whereby the launch platform is connected to elements (16) to bring the launch platform to a desired location underwater, whereby the launch platform is connected via a second cable (5) to a control unit (6) for controlling the launch platform and the cleaning module.

12 Claims, 3 Drawing Sheets

(51) Int. Cl.

| | |
|---|---|
| ***B08B 13/00*** | (2006.01) |
| ***B63B 59/08*** | (2006.01) |
| ***B08B 1/04*** | (2006.01) |
| ***A46B 13/02*** | (2006.01) |
| ***B66C 23/18*** | (2006.01) |
| ***B66C 23/52*** | (2006.01) |
| *B63G 8/00* | (2006.01) |
| *E02B 17/00* | (2006.01) |

(52) U.S. Cl.
CPC ..... *B08B 1/04* (2013.01); *B66C 23/18* (2013.01); *B66C 23/52* (2013.01); *B08B 13/00* (2013.01); *B63G 2008/007* (2013.01); *E02B 17/0034* (2013.01)

(58) Field of Classification Search
CPC ..... B63B 2059/087; B63B 59/10; B63G 2008/007; B63G 2008/008; B08B 1/002; B08B 1/008; B08B 1/04; B08B 13/00
USPC ..... 114/222; 15/1.7
See application file for complete search history.

(56) References Cited

U.S. PATENT DOCUMENTS

| | | | | |
|---|---|---|---|---|
| 7,971,547 | B1 * | 7/2011 | Hertel, III | B08B 1/00 114/222 |
| 2012/0006352 | A1 | 1/2012 | Holappa et al. | |

* cited by examiner

DEVICE AND METHOD FOR CLEANING A SUBMERGED SURFACE OF A VESSEL OR SIMILAR AND USE OF SUCH A DEVICE

FIELD OF THE INVENTION

The present invention relates to a device for cleaning a submerged surface of a vessel or similar.

More specifically, the invention is intended for cleaning all kinds of surfaces that are at least temporarily underwater such as the hull of a ship or boat, the substructure of a platform, offshore constructions or other surfaces of other vessels or similar.

BACKGROUND OF THE INVENTION

It is known that the growth of spores and seed of sea organisms occurs on such surfaces.

This biological growth will lead to a layer of algae, barnacles, slime, mussels and other organisms on the surface, such that 'biofouling' is created.

For ships this biofouling will ensure that the fuel consumption of the ship increases drastically because the ship will experience more resistance while sailing.

Moreover, in this way there will be a spread of these organisms outside their ecosystem.

It is thus important to remove this growth.

Traditionally this is done by taking the ship to a dry dock in order to clean the hull of the ship, but this is a very time-consuming activity.

Alternatively the hull of the ship can be cleaned underwater by divers who brush the hull clean with rotating brushes.

A disadvantage of this is that the divers are exposed to considerable underwater currents, such that their work can constitute considerable risks.

In the open sea, at offshore installations, the risks for divers are simply too great.

Moreover, the use of divers constitutes extra costs.

That is why in some cases the rotating brushes are mounted on a type of underwater robot or 'remotely operated vehicle' whereby this robot ensures the movement of the brushes over the hull of the ship.

The robot is then often provided with a camera to be able to inspect the surface to be cleaned.

A disadvantage of such a device is that the aforementioned camera only enables a small part of the surface to be inspected, such that it cannot often be determined which parts the robot still has to clean.

Moreover the robot is connected to a cable, or 'umbilical cord', that ensures the control of the robot and which leads upwards to a control device on board the ship or on the quay. This cable is relatively thick and not very flexible.

To ensure that the robot can reach all parts of the ship to be cleaned, this cable is necessarily relatively long, often up to one hundred meters and more.

Moreover this cable impedes the movements of the robot, not only due to its weight, but also because it is not very flexible so that it is more difficult for the robot to make sharp movements or bends. A long cable is also more susceptible to the effects of currents.

The purpose of the present invention is to provide a solution to a least one of the aforementioned and other disadvantages.

SUMMARY OF THE INVENTION

The subject of the present invention is a device for cleaning a submerged surface of a vessel or similar, whereby the device is provided with a cleaning module with at least one rotating brush which, upon the movement of the cleaning module, ensures that the cleaning module is pushed or sucked against the aforementioned surface, whereby the device is further provided with a launch platform that can place the cleaning module against the aforementioned surface and is detachable therefrom while it remains connected thereto by means of a first cable for the control of the cleaning module, whereby this launch platform is provided with at least one camera and a drive to move the launch platform underwater, whereby the launch platform is connected to means to bring the launch platform to a desired location underwater, whereby the launch platform is connected via a second cable to a control unit for controlling the launch platform and the cleaning module.

An advantage is that the launch platform can move up to a distance of ten to fifteen meters from the surface and the cleaning module for example, after it has placed the cleaning module on the surface, so that by using the camera on the launch platform at least a proportion of the surface and/or the cleaning module can be observed.

In this way an overview can be obtained of the surface to be cleaned and the already cleaned parts thereof, so that it can easily be determined what parts the cleaning module still has to clean.

In this way the device, in particular the cleaning module, can be controlled better.

Another advantage is that the first cable of the cleaning module runs to the launch platform and not directly to the control unit that is on the vessel.

This means that this cable is much shorter and that it can extend horizontally or approximately horizontally and thereby will not impede the movement of the cleaning module. Moreover, sea currents will have much less of an effect on a shorter cable. There is thus also better control over the movements of the cleaning module.

The invention also concerns a use of a device according to the invention for cleaning the hull and other components of a ship underwater.

The invention also concerns a method for cleaning a submerged surface of a vessel or similar, whereby the method makes use of a device according to the invention and whereby the method comprises the following steps:

lowering the launch platform with the cleaning module fastened thereto underwater to a desired location using means provided to this end;

bringing the launch platform to the surface to be cleaned by using the drive until the cleaning module is placed against the surface;

rotating the brush so that the brush ensures that the cleaning module is pushed or sucked against the aforementioned surface;

detaching the cleaning module from the launch platform and moving it away from the surface;

moving the launch platform to a distance away from the surface so that a desired zone of the surface can be observed with the camera;

moving the cleaning module on the surface on the basis of the observation with the camera.

An advantage of such a method is that it enables the cleaning module and at least a part of the surface to be cleaned to be observed using the camera on the launch platform, so that the cleaning module can be controlled on the basis of this for example.

Moreover, as already noted above, the first cable that connects the cleaning module to the control unit runs via the launch platform instead of directly to this control unit.

This first cable will impede the movement of the cleaning module much less and is also much shorter.

BRIEF DESCRIPTION OF THE DRAWINGS

With the intention of better showing the characteristics of the invention, a few preferred variants of a method and device according to the invention for cleaning a submerged surface of a vessel or similar and the use of such a device are described hereinafter by way of an example, without any limiting nature, with reference to the accompanying drawings, wherein.

DETAILED DESCRIPTION OF THE INVENTION

Figure 1:
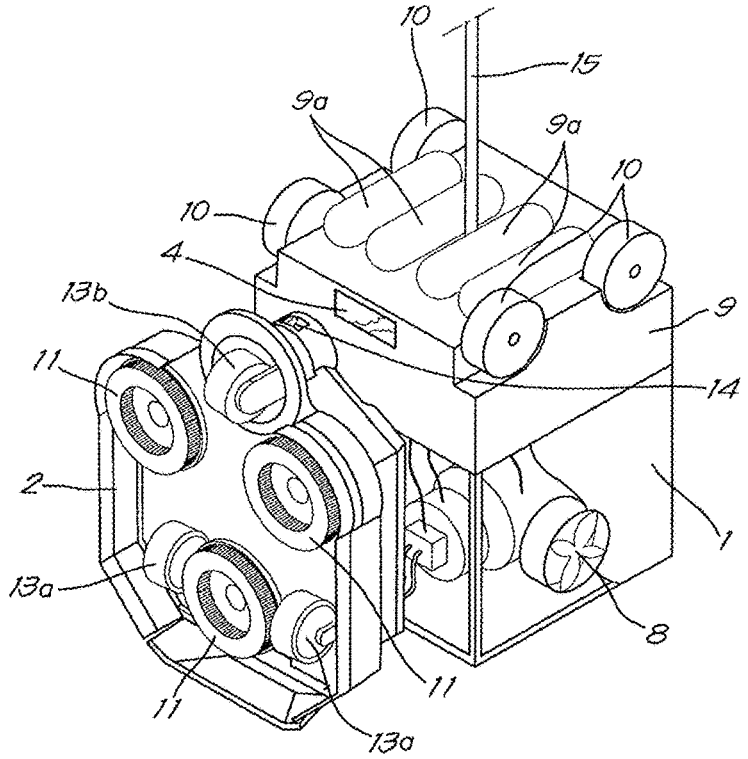
FIG. 1 schematically shows a perspective view of a launch platform with a cleaning module.

FIG. 1 schematically shows a launch platform 1 with a cleaning module 2 of a device 3 according to the invention.

The launch platform 1 and the cleaning module are detachable from one another, which means that they can be released from one another to be able to move or to be moved with respect to one another.

This launch platform 1 can be constructed as a type of cage in which the necessary equipment is affixed and to which the cleaning module 2 can be affixed.

According to the invention the launch platform 1 is provided with a camera 4 and a cable 5.

The camera 4 is a suitable underwater camera that can be provided with lights or similar to improve visibility.

Figure 2:
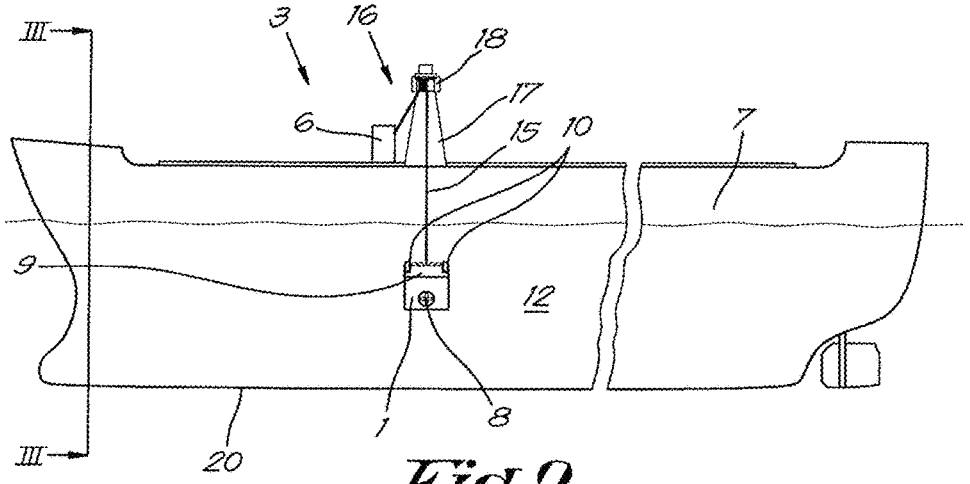
FIG. 2 schematically shows a device according to the invention that is mounted on a vessel.

The cable 5 is connected to a control unit 6 that is on a vessel 7 or similar as shown in FIG. 2.

This cable 5 comprises the necessary connections to be able to control the launch platform 1 with the control unit 6, such as a voltage cable, signal transmission cables and similar.

Via this cable 5, for example, the image generated by the camera 4 is passed on to a display screen in the control unit 6 for example.

According to the invention the launch platform 1 is also provided with a drive 8. Using this drive 8 the launch platform 1 can be moved or displaced underwater.

In this case, but not necessarily, this drive 8 is a hydraulic or electric drive with a rotor, screw or similar.

Furthermore, the launch platform 1 is provided with a ballast tank that can be filled with water or (compressed) air to be able to change the buoyancy in this way.

To this end the launch platform is provided with gas cylinders 9*a* that contain compressed air in order to be able to fill the ballast tank 9 with this compressed air.

Four wheels 10 are also provided, it is not excluded that there are fewer or more wheels 10 for example. Preferably there are at least two wheels 10. It is clear that instead of wheels 10, caterpillar tracks or similar can also be provided.

These wheels are on the top of the launch platform 1, i.e. on the side of the launch platform 1 that is oriented upwards when it is in the water.

As can be seen in FIG. 1, the cleaning module 2 is provided with three brushes 11, which are rotatable and intended to be placed against a surface 12 to be cleaned.

In this case, the cleaning module 2 is provided with three wheels 13*a*, 13*b*, two drive wheels 13*a* and a steering wheel 13*b*, whereby the cleaning module 2 can drive over the surface 12 as it were.

Furthermore, the cleaning module 2 is provided with a camera 14, but this is not necessary for the invention.

The cleaning module 2 is connected by means of a cable 15 to the launch platform 1. This cable 15 is similar to the aforementioned cable 5 to be able to control the cleaning module 2 with the control unit 6.

FIG. 2 shows a device 3 according to the invention that is mounted on a vessel 7, in this case a ship.

Figure 3:
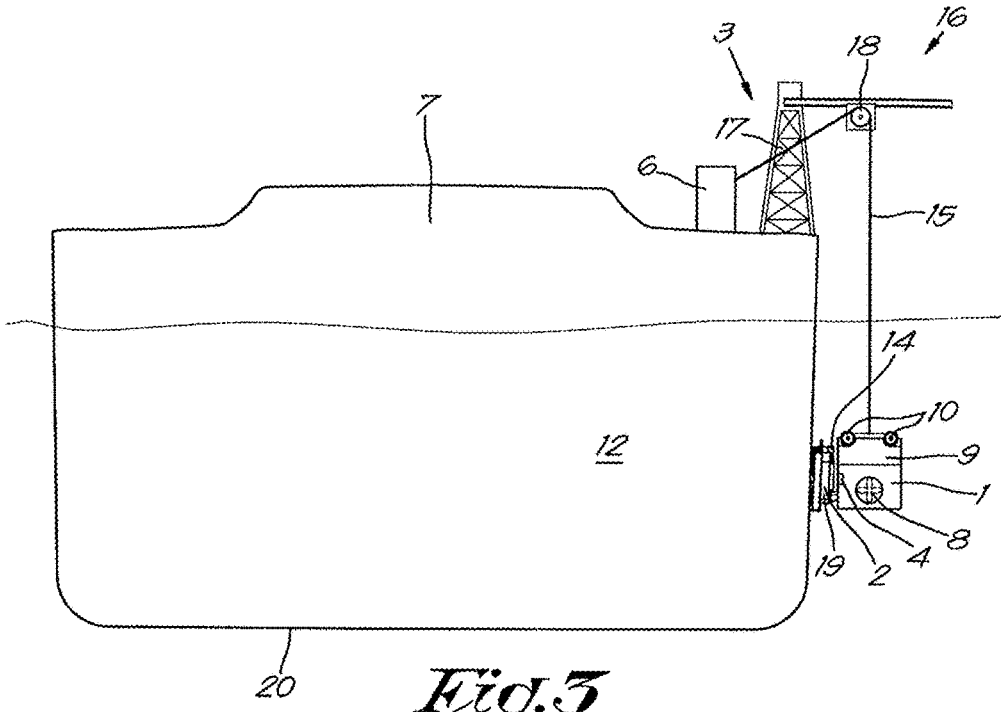
FIG. 3 shows a cross-section according to line III-III of FIG. 2.

FIG. 3 shows another view of the situation in FIG. 2.

In addition to the cleaning module 2 and launch platform 1 shown in FIG. 1, the device 3 also comprises means 16 to place the launch platform 2 at a desired location underwater.

In the example shown, these means 16 are affixed on the ship 7.

In this case the aforementioned means 16 are formed by a hoisting device that comprises a crane 17, which in this case is moved along the periphery of the deck of the ship 7, for example.

The crane 17 can lift the launch platform 1 with the cleaning module 2 on and off the ship 7 and lower it in the water.

In this case, the aforementioned cable 5 forms part of the crane 17 and in the example shown is thus used to raise and lower the launch platform 1 with the crane 17. To this end, this cable 5 is made sufficiently robust, for example in the form of a multiplex cable.

On board the ship 7 a control unit 6 is also affixed, from where the cable 5 leaves towards the launch platform 1 via the crane 17.

The aforementioned cable 5 is thus used for controlling the launch platform 1 and the cleaning module 2 and for the hoisting device.

The device 3 is preferably, but not necessarily, provided with a reel 18 for winding and unwinding the cable 5 that can be provided at the location of the crane 17 for example, and with an additional reel 19 for winding and unwinding the cable 15. This additional reel 19 can be provided in the launch platform 1, for example.

This will ensure that the cable 15 between the launch platform 1 and the cleaning module 2 is always the same length or approximately the same length as the distance between the two, so that this cable 15 lies horizontally or as good as horizontally underwater.

The operation of the device 3 and the use thereof for cleaning the hull and other components of a ship 7 underwater is very simple and as follows.

In a first step the launch platform 1 with the cleaning module 2 coupled thereto is placed underwater to a desired depth using the crane 17, as shown in FIG. 2.

Then the control unit 6 will control the launch platform 1 using the drive 8 in order to bring it to the surface 12 to be cleaned, in this case the hull of the ship 7.

The launch platform 1 will be controlled such that the cleaning module 2 is placed against the surface 12, as shown in FIG. 3.

The brushes 11 of the cleaning module 2 are set in operation. Due to the rotation of the brushes 11 an underpressure occurs between the cleaning module 2 and the surface 12 to be cleaned that ensures that the cleaning module 2 is pushed or sucked firmly against the surface 12.

In this way the brushes 11 always remain in contact with the surface 12.

Figure 4:
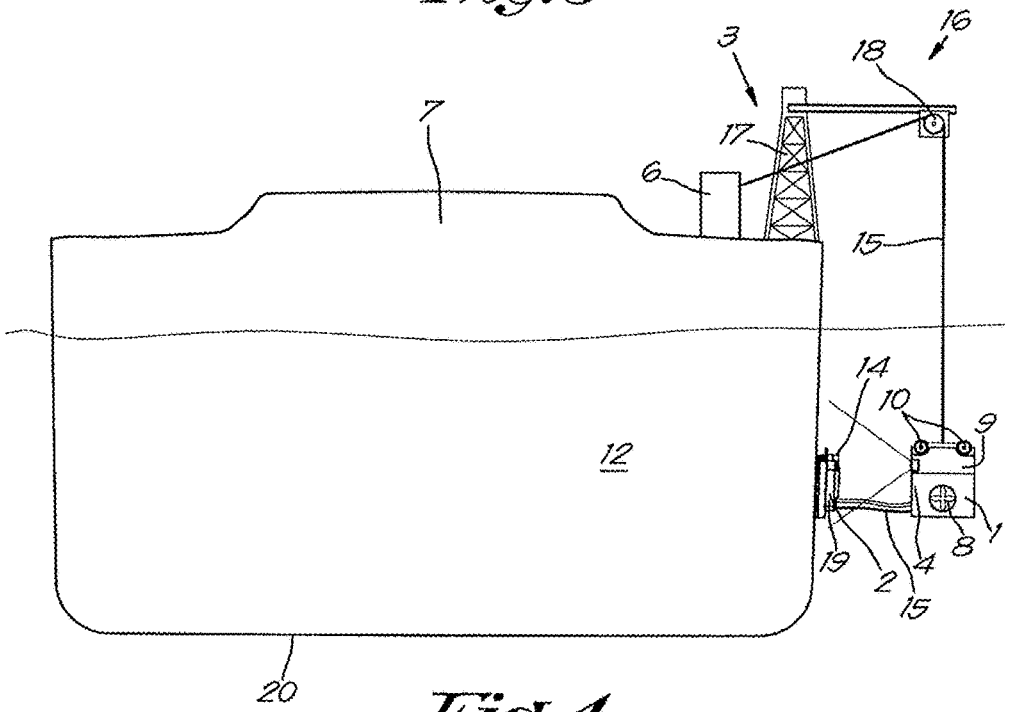
FIG. 4 shows a cross-section of FIG. 3, but in a different position.
Figure 5:
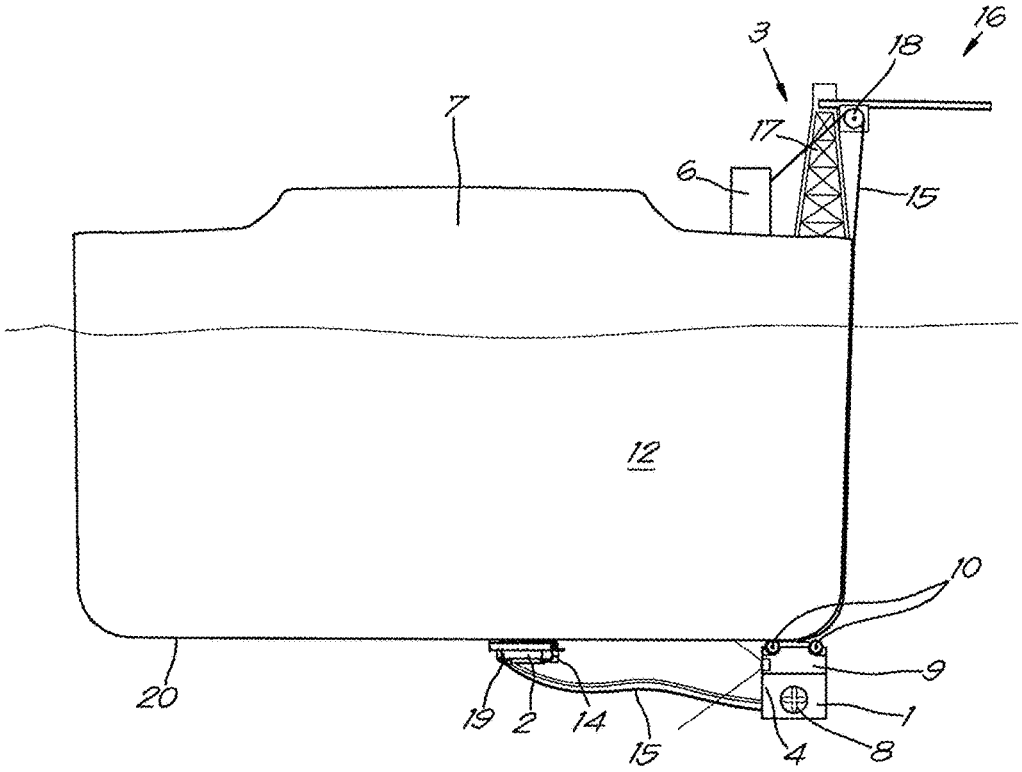
FIG. 5 shows a cross-section of FIG. 3, but in a different position.

Then the cleaning module 2 can be detached from the launch platform 1 and the launch platform 1 can be moved away from the surface 12 and the cleaning module 2 using the drive 8, as shown in FIG. 4, whereby the cleaning module 2 and the launch platform 1 always remain connected together by means of the cable 15 for controlling the drive wheels 13*a* and the steering wheel 13*b*.

It must be noted here that as a result the cable 15 between the cleaning module 2 and the launch platform 1 is as good as horizontal.

The launch platform 1 is placed up to a distance of approximately ten to fifteen meters from the surface 12, so that the camera 4 can observe a desired zone of the surface 12. It must be noted here that the distance depends on the local visibility conditions, the size of the surface 12 to be observed, etc, but is preferably between five and twenty five meters.

The image from the camera 4 is sent to the control unit 6 via the cable 5, so that in this way it can be determined what parts of the surface 12 must be cleaned and where the cleaning module 2 must be moved over the surface 12.

By controlling the drive wheels 13*a* and steering wheel 13*b* the cleaning module 2 can drive over the surface 12 according to a desired path or route.

Hereby its movements will not be impeded by the cable 15.

By suitably controlling the additional reel 19 it can be ensured that the cable 15 between the cleaning module 2 and the launch platform 1 is kept at the suitable length during the movement of both the cleaning module 2 and the launch platform 1 so that this cable 15 is always horizontal or approximately horizontal.

Using the reel 18 the cable 5 will also be able to be kept at a suitable length from the launch platform 1 to the control unit 6.

The camera 14 on the cleaning module 2 will be able to observe the part of the surface 12 just cleaned so that in this way it can be checked whether the cleaning is being done properly by the brushes 11.

When the surface 12 to be cleaned has been completely cleaned and the hull of the ship 7 is thus free of biological growth, the launch platform 1 is brought to the cleaning module 2. The brushes 11 of the cleaning module 2 are switched off, so that the underpressure is removed and the cleaning module 2 is detached from the cleaned surface 12.

Using the crane 17 the launch platform 1 is brought back upwards and lifted on deck.

To clean the underside of a horizontal or as good as horizontal section 20 of a surface 12 to be cleaned, such as for example the bottom of the hull of the ship 7, use is made of the ballast tank 9 and the wheels 10 of the launch platform 1.

When the cleaning module 2 has to treat such a section 20, the launch platform 1 will be moved under this section 20. Then the ballast tank 9 will at least be partially filled with air, so that the buoyancy will increase such that the launch platform 1 with the wheels 10 comes against the section 20.

By driving the wheels 10 with the control unit 6, the launch platform 1 will be able to move over the horizontal section 20 of the surface 12, and in this way will follow the cleaning module 2 so that the camera 4 on the launch platform 1 can follow the surface to be cleaned and the cleaning module 2.

Because the launch platform 1 is pressed against the section 20 of the surface 12, it will be relatively stable.

It is clear that although in the example shown the means 16 for bringing the launch platform 1 to a desired depth underwater are on the vessel 7 itself, it is not excluded for example that these means 16 are on the quay or another nearby vessel. In other words, the device 3 is not built on the vessel 7. It is also possible that the device 3 can be moved from a ship to be cleaned to another location, such as another ship 7 to be cleaned or a storage place.

Although in the examples shown the device 3 only comprises one cleaning module 2, it is possible that a number of cleaning modules 2 are provided, that can each be affixed on the launch platform 1 and which are each connected to the launch platform 1 by its own cable 15.

This has the advantage that the surface 12 to be cleaned can be treated more quickly using the device 3, because more than one cleaning module can be deployed simultaneously.

The present invention is by no means limited to the embodiments described as an example and shown in the drawings, but such a method, device and the use thereof can be realised according to different variants, without departing from the scope of the invention.

The invention claimed is:

1. A device for cleaning a submerged surface of a structure, said device comprising:

a cleaning module;

said cleaning module comprising at least one rotating brush which, upon movement of the cleaning module, ensures that the cleaning module is pushed or sucked against the submerged surface;

a launch platform that places the cleaning module against the submerged surface, said launch platform being detachable therefrom while remaining connected thereto via a first cable that controls the cleaning module, wherein:

said launch platform comprises at least one camera and a drive that moves the launch platform underwater, the launch platform is connected to a transporting device that brings the launch platform to a desired location underwater, and the launch platform is connected via a second cable to a control unit that controls the launch platform and the cleaning module.

2. The device according to claim 1, wherein the transporting device that brings the launch platform to the desired location underwater is a hoisting device.

3. The device according to claim 2, wherein the cleaning module is provided with at least one camera.

4. The device according to claim 2, wherein said transporting device is a crane.

5. The device according to claim 1, wherein the cleaning module comprises at least one camera.

6. The device according to claim 1, wherein said drive comprises a rotor or screw that moves the launch platform underwater.

7. The device according to claim 1, wherein the launch platform comprises a ballast tank and at least two wheels.

8. The device according to claim 1, wherein the transporting device that brings the launch platform to the desired location underwater is movably affixed on the structure.

9. The device according to claim 1, further comprising at least one reel that winds and unwinds at least one of the first cable and second cable.

10. The device according to claim 1, further comprising a at least one cleaning module, each of said at least one cleaning modules being connected to the launch platform by a separate first cable.

11. A method for cleaning a submerged surface, wherein said method makes use of the device according to claim 1, said method comprising:

lowering the launch platform with the cleaning module fastened thereto underwater to a desired location using the transporting device;

bringing the launch platform to the submerged surface by using the drive until the cleaning module is placed against the submerged surface;

rotating the brush so that the brush ensures that the cleaning module is pushed or sucked against the submerged surface;

detaching the cleaning module from the launch platform and moving it away from the submerged surface;

moving the launch platform to a distance away from the surface so that a desired zone of the submerged surface can be observed with the camera;

moving the cleaning module on the submerged surface on the basis of the observation with the camera.

12. The method according to claim 11, wherein the submerged surface is an underside of a substantially horizontal section of the submerged surface, and wherein the launch platform is provided with a ballast tank and at least two wheels, said method further comprising:

when the cleaning module cleans the submerged surface, bringing the launch platform to below the submerged surface;

at least partially filling the ballast tank with air so that the wheels of the launch platform come up against the submerged surface under the influence of the buoyancy; and moving the launch platform over the submerged surface by driving the wheels.

* * * * *